US005309643A

United States Patent [19]

McCollom

[11] Patent Number: 5,309,643

[45] Date of Patent: May 10, 1994

[54] ADAPTER APPARATUS MOUNTED ON A MARKING INSTRUMENT TO ACHIEVE MOVEMENT IN A STRAIGHT LINE

[76] Inventor: Robert M. McCollom, 3101 N. Elizabeth, Pueblo, Colo. 81008

[21] Appl. No.: 885,535

[22] Filed: May 19, 1992

[51] Int. Cl.[5] ..... B43L 13/00

[52] U.S. Cl. ..... 33/32.2; 15/437; 401/48

[58] Field of Search ..... 33/32.2, 32.1, 35–37, 33/41.1, 41.6, 779–782; 15/437; 401/48

[56] References Cited

U.S. PATENT DOCUMENTS

| | | | |
|---|---|---|---|
| 211,825 | 1/1879 | Worthington | 33/27.05 |
| 569,038 | 10/1896 | Dow | 15/437 |
| 683,780 | 10/1901 | Moojeski | 33/27.05 |
| 2,362,992 | 11/1944 | Dentzler, Jr. | 401/48 |
| 2,543,009 | 2/1951 | Frost | 33/32.2 X |
| 2,697,416 | 12/1954 | Simmons | 401/48 |
| 4,680,864 | 7/1987 | Heagerty | 33/322 X |
| 4,858,328 | 8/1989 | Heinen | 33/779 X |

FOREIGN PATENT DOCUMENTS

| | | | |
|---|---|---|---|
| 0205496 | 7/1955 | Australia | 33/27.05 |
| 0247732 | 3/1948 | Switzerland | 33/41.6 |
| 3047 | 12/1990 | Switzerland | 33/41.6 |
| 422611 | 1/1935 | United Kingdom | 33/779 |
| 1035135 | 7/1966 | United Kingdom | 33/27.05 |

*Primary Examiner*—Thomas B. Will
*Attorney, Agent, or Firm*—Phillip A. Rein

[57] ABSTRACT

An adapter apparatus mounted on a marking instrument to achieve movement in a straight line for marking through a pen/pencil member; highlighting with use of a highlighter pen member; magnifying fine print for ease of reading; and cutting a a support surface with movement in a straight line. The pen/pencil adapter assembly includes 1) a main support member connected to the marking instrument; 2) an alignment and ruler member connected to the main support member for measuring and and movement in a straight line; and 3) a support wheel assembly connected to the alignment and ruler member to achieve movement in a straight line on the support surface. Other embodiments include a magnifying adapter assembly having a magnifying member to magnify fine print; a pen/pencil adapter assembly having a projection support assembly; a highlighter adapter assembly for highlighting; and a cutter adapter assembly for cutting a surface in a straight line.

8 Claims, 3 Drawing Sheets

ADAPTER APPARATUS MOUNTED ON A MARKING INSTRUMENT TO ACHIEVE MOVEMENT IN A STRAIGHT LINE

PRIOR ART

A patent search on this invention revealed the following U.S. Pat Nos.:

| U.S. Pat. No. | Invention | Inventor |
|---|---|---|
| 3,179,089 | MECHANICAL PENCIL ASSEMBLY | Joseph A. Civitarese |
| 3,266,157 | STYLE GRIPPER RULER | Leslie L. De Mathe |
| 3,419,335 | DRAFTING DEVICE | Edward Bok |
| 3,520,628 | PAINT TRIM ROLLER AND ADJUSTABLE GUIDE ASSEMBLY | Francesco Moceri |
| 3,605,269 | DRAFTING AID | James C. Driskill |
| 3,797,706 | PAINT AND ADHESIVE APPLICATOR | Leonard C. Mule |
| 4,369,580 | DRAFTING PEN ACCESSORY | Richard C. Pruitt |
| 4,680,864 | DRAWING GUIDE | Michael S. Heagerty |
| 4,757,616 | RULER WITH MAGNIFYING CURSOR | Brian Hills |
| 4,906,119 | HANDWRITING STABILIZER | Hartford et al |
| 4,932,565 | CAULKING AND LIKE GUN WITH GUIDE | Thomas J. Paradiso |

The Civitarese patent discloses a mechanical pencil assembly having a roller member connected to an elaborate gear mechanism with the purpose and function of this invention to rotate a lead pencil member.

The De Mathe patent discloses a style gripper ruler having a pair of parallel roller members operable to move up and down a page in a straight line. The gripper ruler has a slot therein whereupon a pen or pencil can be used to draw straight lines.

The Bok patent discloses a drafting device having an element to control pressure against paper.

The Moceri patent discloses a paint trim roller and adjustable guide assembly.

The Mule, Pruitt, and Paradiso patents disclose various drafting aid, paint applicator, and caulking gun structures.

The Hills patent discloses a ruler with a magnifying glass but isn't operable to read book, magazine, or newspaper print.

The Hartford et al patent discloses a handwriting stabilizer with a ball bearing support to achieve smooth writing or printing.

The Driskill patent discloses a drafting aid having a pencil holder used with wheels or bearings.

The Heagerty patent discloses a drawing guide having a holder therein for a pen or pencil and having spaced rotating wheel members usable in an aligned condition as shown in FIG. 1. This reference discloses a graduated scale and rubber contact area on the wheel members.

PREFERRED EMBODIMENT OF THE INVENTION

In one preferred embodiment of this invention, an adapter apparatus is operable to be mounted on a marking instrument to achieve movement in a straight line for purposes of underlining, highlighting, print magnifying, or cutting functions. The marking instrument can be a support instrument, a pen or pencil member, a highlighter pen member, or other such support structures to be held and manipulated by a user's hand.

In one embodiment, the adapter apparatus is a pen/pencil adapter assembly operable to be mounted on a pen/pencil member for underlining on movement in a straight line.

The pen/pencil adapter assembly includes 1) a main support member operable to be slidingly mounted on the pen/pencil member for selective movement relative to a longitudinal axis from storage to usage positions and visa versa; 2) an alignment and ruler member connected to the main support member; and 3) a support wheel assembly mounted on the alignment and ruler member for contact with a paper, pad member, book or other such support structure for moving thereon in a straight line.

The main support member includes a cylindrical housing section mounted about the pen/pencil member in a clamping relationship and connected through an inclined connector flange to the alignment and ruler member.

The cylinder housing section includes a protrusion receiving hole to receive a lock protrusion element on the pen/pencil member when in the usage condition or moved to a storage position for clipping onto a person's shirt pocket or the like.

The inclined connector flange includes an inclined connector section having the alignment and ruler member pivotally connected thereto and provided with a lock protrusion portion.

The alignment and ruler member includes a main ruler body section having an integral outer curved guide section and length measurement indicia thereon. The main ruler body section has a protrusion receiving hole which is selectively engagable with the lock protrusion portion on the inclined connector flange to hold in a locked but releasable condition when moved into the storage condition.

The length measurement indicia has upper and lower markings thereon on an outer face of the main ruler body section to indicate length of movement of the alignment and ruler member in a straight line.

The support wheel assembly includes a pair of identical spaced support wheel members which are rotatably mounted against a front surface of the main ruler body section of the alignment and ruler member.

Each support wheel member includes a main wheel body having an inclined support wall section which provides support on a support surface with contact across its entire face when the pen/pencil member is angled approximately 60 degrees to a support surface during a usage operation. This moves a marking element of the pen/pencil member in a straight line which is desirable when underlining printed words in a newspaper, magazine, book, or other similar structure.

In a second embodiment of the adapter apparatus, a magnifying adapter assembly is provided having the previously described pen/pencil adapter assembly with a magnifying assembly connected thereto.

The pen/pencil adapter assembly in this embodiment has the main support member which is connectable to the pen/pencil member; the alignment and ruler member mounted on the main support member; and the support wheel assembly connected to the alignment and ruler member for moving in a straight line.

The magnifying assembly includes a magnifying member connected by a pivot support assembly to the alignment and ruler member. The magnifying member is movable from a storage condition parallel and adjacent to the alignment and ruler member to a position 90 degrees therefrom so as to provide magnifying for reading newspaper, magazine print, or the like by moving in a straight line being supported on the support wheel assembly.

In a third embodiment of the adapter apparatus, a pen/pencil adapter assembly includes the main support member connectable to the pen/pencil member, the alignment and ruler member mounted on the main support member, and a projection support assembly connected to the alignment and ruler member to replace the previously described support wheel assembly.

The projection support assembly includes a pair of spaced bearing dipple members secured and extended outwardly to a lower edge of the alignment and ruler member to provide an outer arcuate contact surface.

The arcuate contact surface then operates on the pad, magazine, or support surface to guide the alignment and ruler member in a straight line similar to the support wheel assembly in the first embodiment.

In a fourth embodiment of the adapter apparatus, a highlighter adapter assembly is provided which is readily connectable to the highlighter pen member to use a felt tip element and having an enclosure cap member to selectively enclose the felt tip element in a non-use/storage condition.

The highlighter adapter assembly includes a pocket clip or flange member connected to a cylindrical housing section which is slidably engagable with an outer surface of the highlighter pen member and being axially movable thereon from a usage to a non-usage condition. The cylindrical housing section has an observation cut-out section for observing the felt tip element of the highlighter pen member during usage.

The highlighter adapter assembly further includes the aforementioned alignment and ruler member having a support wheel assembly connected thereto.

The highlighter adapter assembly includes a lock ring on an integral surface of the cylindrical housing section selectively engagable with one of two spaced grooves on a lock section of the highlighter pen member to hold in the usage and non-usage storage conditions.

In a fifth embodiment of the adapter apparatus, a cutter adapter assembly is provided with the main support member, the alignment and ruler member, and the support wheel assembly for movement in a straight line.

The cutter adapter assembly includes a cutter blade assembly having a main blade body which is connected to an outer surface of the alignment and ruler member. The cutter blade assembly is selectively pivotal to a position placing an inclined cutter edge in alignment with the alignment and ruler member.

The main blade body is locked in the usage condition being of a length to provide a cutting action by the cutter edge when moving in a straight line to cut a magazine, newspaper article or grocery coupon.

The support wheel assembly is provided with identical spaced support wheel members, one having a wheel rotation measurement indicia on a front wall section thereof.

The front wall section is integral with the inclined support wall section which has a flat wall portion positioned at zero indicia on the wheel rotation measurement indicia. This flat wall portion on one of the support wall members provides a tapping or vibration feeling on each rotation of the respective support wheel member so that the number of rotations can be noted and counted by the user of most embodiments of the adapter apparatus.

OBJECTS OF THE INVENTION

One object of this invention is to provide an adapter apparatus which can be releasably mounted on a marking instrument to achieve movement in a straight line with the marking instrument being a pen/pencil member or a highlighter pen member on which can be mounted on a magnifying glass thereon for reading fine print or a cutter adapter assembly for a cutting function on a magazine or newspaper article with movement in a straight line.

A second object of this invention is to provide an adapter apparatus readily mounted on a marking instrument such as a pen/pencil member or a highlighter pen member with an alignment and ruler member mounted on support wheel assemblies for contacting and moving in a straight line on a support surface.

Another object of this invention is to provide a pen/-pencil adapter assembly slidably mounted on a pencil member and locked in usage and non-usage conditions and having an alignment and ruler member which is pivotal from a usage and locked in a storage position for alignment to a person's shirt pocket or the like for storage and conveyance.

One other object of this invention is to provide an adapter apparatus which is mountable on a pen, pencil, or highlighter member having a magnifying adapter assembly with a magnifying member which is movable from storage to usage condition and movable in a straight line for reading fine print and the like.

A further adapter of this invention is to provide an adapter apparatus having a pen/pencil adapter assembly with an alignment and ruler member mounted on a projection support assembly having bearing dipple members with outer arcuate contact surfaces for contacting a support surface and moving in a straight line for reading through magnification, cutting with a cutter blade assembly, highlighting with a highlighter pen member, or marking with a pen/pencil member.

One further object of this invention is to provide an adapter apparatus having a highlighter adapter assembly which is mounted on a highlighter pen, selectively movable from usage to storage position, and having an alignment and ruler member mounted on a support wheel assembly for highlighting magazines, books, newspaper print, or the like.

Another further object of this invention is to provide an adapter apparatus having a cutter adapter assembly mounted on a pen/pencil member or highlighter pen member and having a cutter blade assembly which is movable from a storage to a usage condition for cutting a support surface while moving in a straight line.

Still, one further object of this invention is to provide an adapter apparatus mounted on a marking instrument to achieve movement in a straight line for the purposes of marking with a pen/pencil member; highlighting with a felt tip element; cutting with a blade member; magnifying with a magnifying glass; measurement with rotation of support wheel members of a support wheel assembly; and further being economical to manufacture, simple to use, readily movable from usage to storage conditions, and substantially maintenance free.

Various other objects, advantages, and features of the invention will become apparent to those skilled in the art from the following discussion, taken in conjunction with the accompanying drawings, in which:

FIGURES OF THE INVENTION

FIG. 12 is a perspective view of the highlighter adapter assembly inverted from the view in FIG. 11 and as shown in a non-usage or or storage condition for attachment to a user's pocket member or the like;

Figure 1:
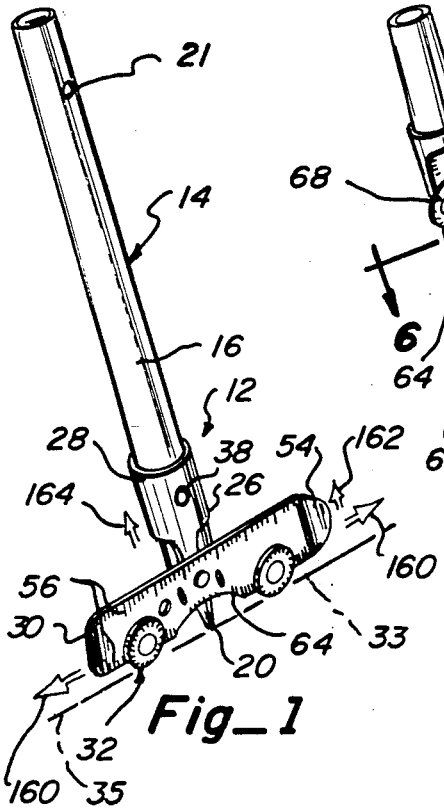
FIG. 1 is a perspective view of a first embodiment of an adapter apparatus being a pen/pencil adapter assembly mounted on a pen/pencil member of this invention mounted thereon in a usage position.

The following is a discussion and description of preferred specific embodiments of the adapter apparatus of this invention, such being made with reference to the drawings, whereupon the same reference numerals are used to indicate the same or similar parts and/or structure, it is to be understood that such discussion and description is not to unduly limit the scope of the invention.

DESCRIPTION OF THE INVENTION

Figure 2:
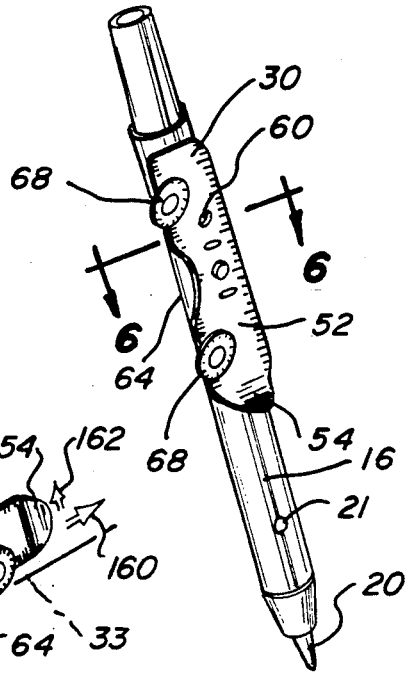
FIG. 2 is a perspective view similar to FIG. 1 illustrating the pen/pencil adapter assembly retracted to a storage position.
Figure 3:
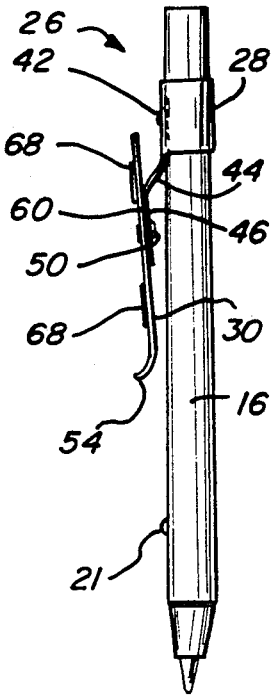
FIG. 3 is a side elevational view of the pen/pencil adapter assembly in the storage position.
Figure 4:
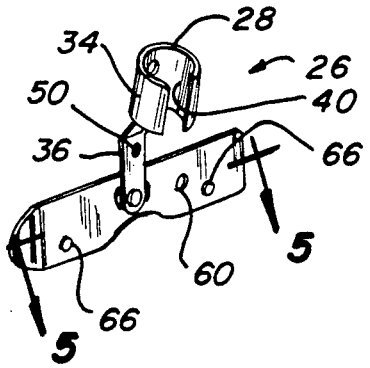
FIG. 4 is a perspective view of a back side of the pen/pencil adapter assembly.

Referring to the drawings in detail and, in particular, to FIGS. 1-3, an adapter apparatus of this invention, indicated generally at 12, is operable to be mounted on a marking instrument to achieve movement in a straight line for the purpose of drawing a straight line with a marking or support instrument 14 which may be a pen or pencil 16, highlighter pen member 18, or similar type structures.

The adapter apparatus 12 is further operable in various embodiments to provide a marking instrument for drawing visible lines, a magnifying member for reading small print, a highlighter element for highlighting magazine or newspaper print, and a cutter blade member in order to cut out newspaper and/or magazine articles or the like.

The pen/pencil member 16 has a marking element 20 to mark a line with lead or ink in a conventional manner. The highlighter pen member 18 is provided with an outer felt tip element 22 and having an enclosure cap member 24 to enclose the felt tip element 22 when not being used to prevent same from drying out and, thus, inoperable.

In a first embodiment of the adapter apparatus 12 as noted in FIGS. 1-6, a pen/pencil adapter assembly 26 is provided having 1) a main support member 28 connectable to a pen/pencil member 16; 2) an alignment and ruler member 30 pivotally connected to the main support member 28; and 3) a support wheel assembly 32 mounted on the alignment and ruler member 30 for support and ease of movement on a support surface 33.

The main support member 28 includes a cylindrical housing section 34 to mount about an outer surface of a pen/pencil member 16 and having an inclined connector flange 36 to which the alignment and ruler member 30 is pivotally connected.

The cylindrical housing section 34 has a protrusion receiving hole 38 operable to selectively engage and receive one of two spaced lock protrusion elements 21 on the pen/pencil member 16 to hold in either a usage or non-usage condition as will be explained. The cylindrical housing section 34 has an expandable lock slot 40 which allows it to expand and contract firmly about the pen/pencil member 16.

The inclined connector flange 36 has a connector section 42 integral at one end with the cylindrical housing section 34 and at an opposite end with an offset intermediate section 44 which is integral with an inclined connector section 46.

The inclined connector section 46 has a connector hole 48 therein and a lock protrusion portion 50 which is engagable with the alignment and ruler member 30 to hold in a storage condition as will be explained.

The alignment and ruler member 30 is of a plate construction having a main ruler body section 52 with an integral outer curved clip section 54 and length measurement indicia 56 on an outer face of the main ruler body section 52.

The length measurement indicia 56 has upper and lower sets thereof so as to be readily visible during usage to measure distance traveled along the straight line 35.

Figure 5:
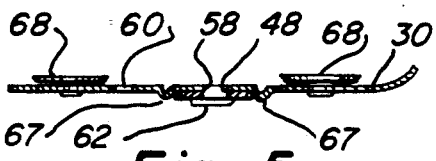
FIG. 5 is an enlarged sectional view taken along line 5—5 in FIG. 4.
Figure 6:
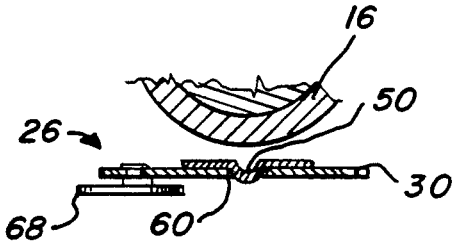
FIG. 6 is an enlarged fragmentary sectional view taken along line 6—6 in FIG. 2.

The main ruler body section 52 includes 1) a pivot connector hole 58; 2) a protrusion receiving hole 60 to receive the lock protrusion portion 50 therein when in the conveyance or storage mode of FIGS. 2, 3, and 6; 3) a pivot connector member 62 being a rivet or shaft member mounted within the pivot connector holes 48, 58 for pivotal movement; 4) an observation cut-out section 64 to observe the marking element 20 of the pen/pencil member 16; 5) a pair of spaced wheel support holes 66 to receive the support wheel assembly 32 therein; and 6) a pair of parallel spaced locked protrusion members 67 to hold in the usage conditions as best noted in FIG. 5.

The outer curved clip section 54 is operable to cooperate with a main body of the pen/pencil member 16 for clipping into a user's pocket member in a conventional manner.

The length measurement indicia 56 can be provided with various scales, such as in 1/16 inch or metric measurements and with one being one in inches and the other in metric measurements.

The support wheel assembly 32 includes a pair or identical support wheel members 68 rotatably mounted on respective wheel support shafts 72 in the wheel support holes 66.

Each support wheel assembly 32 includes a support wheel member 68 including a main wheel body 70 having a front wall section 74 parallel to a rear wall section 76 and having an outer inclined support wall section 78.

The support wall section 78 is inclined approximately 60 degrees relative to the wheel support shaft 72 in order to maintain a proper angle of inclination of the main ruler body section 52 and the pen/pencil member 16 during usage. The inclined support wall section 78 is in full contact through an outer surface engagable with the support surface 33 of a magazine, book, or the like. The angle of inclination, preferably 60 degrees ±5 degrees, is clearly noted in FIGS. 9 and 15 during usage thereof. More details of the respective support wheel members 68 will be discussed in detail relative to FIGS. 15–17, inclusive.

Figure 7:
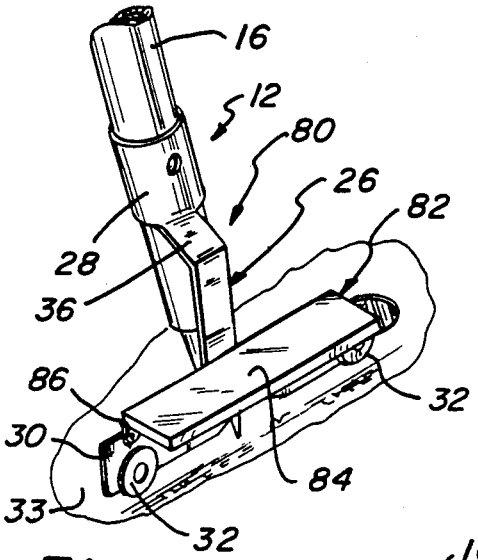
FIG. 7 is a perspective view illustrating a second embodiment of the adapter apparatus being a magnifying adapter assembly mounted on a pen/pencil member.
Figure 8:
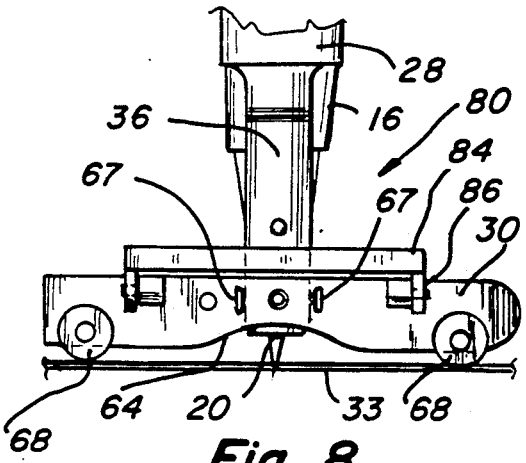
FIG. 8, is an elevated front elevational view of the magnifying adapter assembly.
Figure 9:
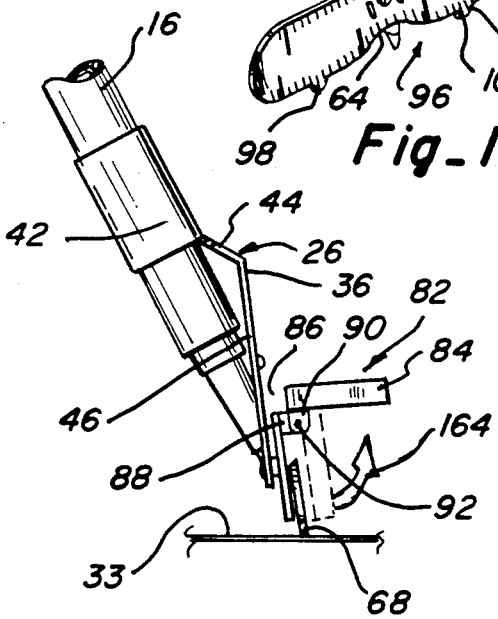
FIG. 9 is a side elevational view of the magnifying adapter assembly as mounted on a support surface.

In a second embodiment of the adapter apparatus 12 as shown in FIGS. 7–9, a magnifying adapter assembly 80 includes a pen/pencil adapter assembly 26 having a magnifying assembly 82 connected thereto.

The pen/pencil adapter assembly 26 is as previously described having the main support member 28 with the alignment and ruler member 30 pivotally connected thereto and the support wheel assembly 32 connected to the alignment and ruler member 30.

The magnifying assembly 82 includes 1) a magnifying member 84 of rectangular plate shape constructed of a glass or plastic magnifying material; and 2) a pivot support assembly 86 operable to pivotally connect the magnifying member 84 to a front surface of the alignment and ruler member 30.

The pivot support assembly 86 includes 1) a first lug member 88 secured to an upper front surface of the alignment and ruler member 30; 2) a second lug member 90 connected to the magnifying member 84; and 3) a connector pin 92 mounted within aligned openings in the first lug member 88 and the second lug member 90. This allows for pivotal movement of the magnifying member from a storage condition as noted in dotted lines in FIG. 9 to the usage position shown in solid lines being extended perpendicular to the alignment and ruler member 30.

Figure 10:
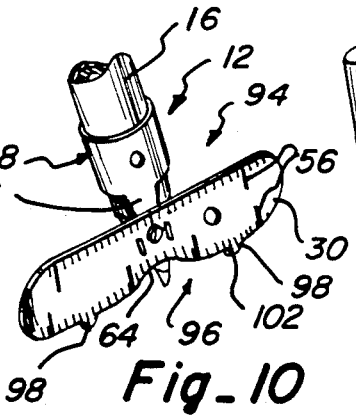
FIG. 10 is a perspective view of a third embodiment of the adapter apparatus being a pen/pencil adapter assembly as attached to a pen/pencil member.

In a third embodiment of the adapter apparatus 12 of this invention as noted in FIG. 10, a pen/pencil adapter assembly 94 includes 1) the main support member 28 having the alignment and ruler member 30 pivotally connected thereto as previously described; and 2) a projection support assembly 96 mounted on and integral with the alignment and ruler member 30 instead of utilizing the support wheel assembly 32 in the other embodiments.

The projection support assembly 96 includes a pair of spaced, aligned, bearing dipple members 98 having an outer arcuate contact surface 102. The bearing dipple members 98 take the place of the support wheel assembly 32 and allows the outer arcuate contact surface 102 to move in a straight line along a support surface 33 to achieve a straight line 35.

Figure 11:
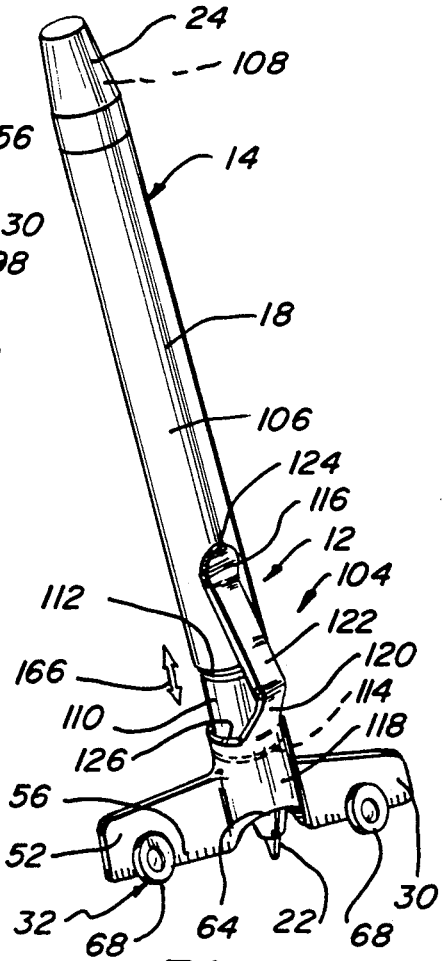
FIG. 11 is a perspective view of a fourth embodiment of the adapter apparatus being a highlighter adapter assembly mounted on a highlighter pen member shown in the usage condition.
Figure 12:
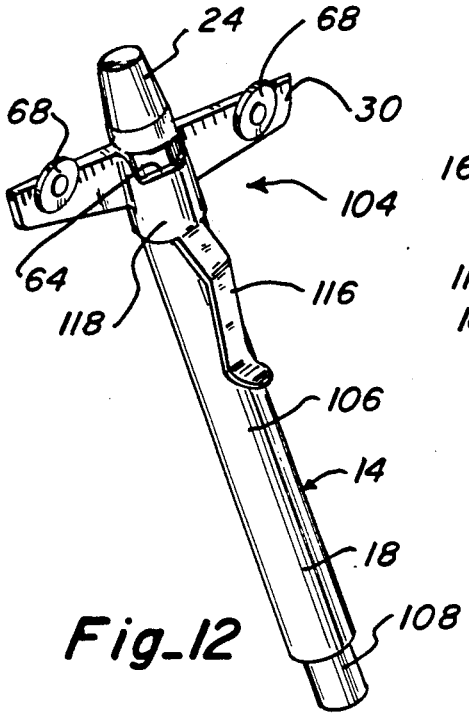

In a fourth embodiment of the adapter apparatus 12 of this invention as noted in FIGS. 11 and 12, a highlighter adapter assembly 104 is utilized with the highlighter pen member 18.

In more detail, the highlighter pen member 18 includes a main pen body 106 having a cap storage end 108 and a lock section 110. The cap storage end 108 is operable to receive the enclosure cap member 24 thereon to enclose the felt tip element 22 when in the non-usage storage condition as shown in FIG. 12.

The lock section 110 includes two spaced lock grooves 112 adapted to selectively receive a lock ring 114 present in the highlighter adapter assembly 104 as will be explained.

The highlighter adapter assembly 104 includes 1) a pocket clip or flange member 116; 2) a cylindrical housing section 118 connected to the pocket clip member 116; 3) the alignment and ruler member 30 connected to the cylindrical housing section 118; and 4) the support wheel assembly 32 connected to the alignment and ruler member 30.

The pocket clip member 116 is provided with 1) a connector portion having one end integral with the cylindrical housing section 118; 2) an intermediate connector portion 122 connected to the connector portion 120; and 3) an outer inclined connector portion 124 integral with the intermediate connector portion 122.

It is seen that the pocket clip member 116 is operable in cooperation with the main pen body 106 for attachment to a pocket area of a person utilizing same when being placed in a non-usage or storage condition.

The cylindrical housing section 118 includes a pen receiving hole 126 to receive the highlighter pen member 18 therethrough and having an observation cut-out section 64 so as to readily observe the felt tip element 22 when in the usage condition as noted in FIG. 11.

The support wheel assembly 32 is as previously described having a pair of spaced support wheel members 68 operable to surface 33 when in a highlight marking operation.

Figure 13:
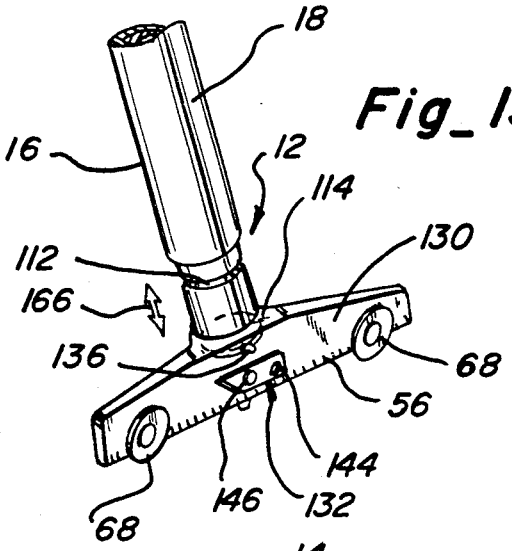
FIG. 13 is a perspective view of a fifth embodiment of the adapter apparatus being a cutter adapter assembly as mounted on the highlighter pen member.
Figure 14:
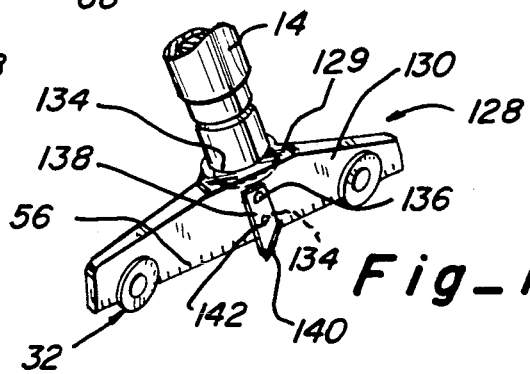
FIG. 14 is a perspective view similar to FIG. 13 illustrating a cutter blade assembly in its usage condition for a cutting function.

In a fifth embodiment of the adapter apparatus 12 as noted in FIGS. 13 and 14, a cutter adapter assembly 128 is operable to be connected to the marking or support instrument 14 which could be the pen/pencil member 16 or the highlighter pen member 18.

The highlighter pen member 18 is provided with the previously described lock groove 112 and a lock ring 114 in the cutter adapter assembly 128 for holding in the usage or non-usage condition as will be explained.

The cutter adapter assembly 128 includes 1) a main support member 129 to receive the support instrument 14 connected thereto; 2) an alignment and ruler member 130 integral with the main support member 129; 3) the support wheel assembly 32 connected to the alignment and ruler member 130; and 4) a cutter blade assembly 132 pivotally connected to the alignment and ruler member 130.

The main support member 129 has an instrument receiving hole 134 to receive the highlighter pen member 18 therein.

The alignment and ruler member 130 is provided with a lock protrusion member 136 engagable with the cutter blade assembly 132 to hold in the upright usage cutting position as will be noted.

The alignment and ruler member 130 is substantially similar in purpose and operation as the alignment and ruler member 30 previously described as having length measurement indicia 56 thereon and the rotatable support wheel members 68 therein.

The cutter blade assembly 132 includes 1) a main blade body 138 having an outer inclined cutter edge 140; 2) a pivot connector hole 142; 3) an anchor hole 144; and 4) a blade pivot shaft 146 mounted through the pivot connector hole 142 and into a support hole in the alignment and ruler member 130 for pivotal movement from the storage condition of FIG. 13 to the usage condition of FIG. 14 and visa versa.

The anchor hole 144 is engagable with the lock protrusion member 136 when in the usage condition of FIG. 14 and with a storage protrusion member 145 when in the storage condition of FIG. 13.

Figure 15:
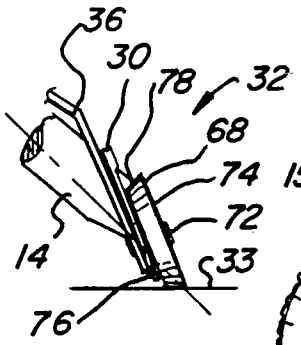
FIG. 15 is a fragmentary side elevational view illustrating a support wheel member on a support wheel assembly to be utilized with any of the embodiments of the adapter apparatus except the third embodiment.
Figure 17:
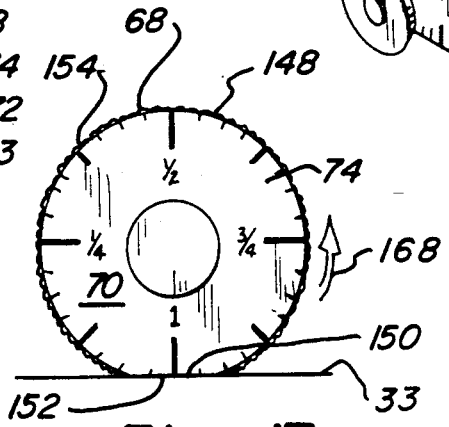
FIG. 17 is an enlarged elevational view illustrating a front wall of a support wheel member of the support wheel assembly.
Figure 16:
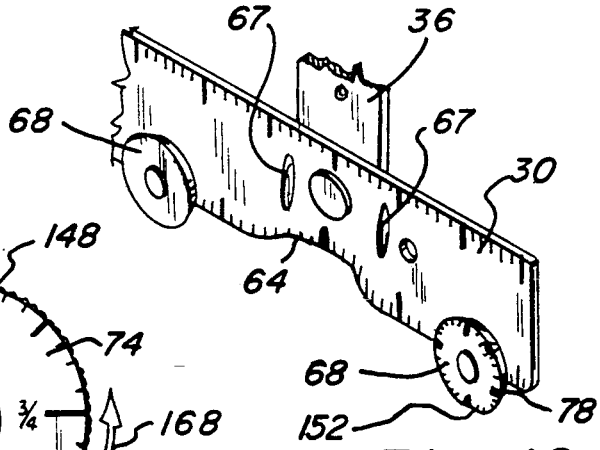
FIG. 16 is a fragmentary perspective view illustrating mounting of the support wheel assembly on the alignment and ruler member of any embodiments of the adapter apparatus.

Details of the support wheel assembly 32 with rotation counter elements is shown in FIGS. 15–17, inclusive. The support wheel assembly 32, as noted in FIG. 15, is shown as attached to the alignment and ruler member 30 which, in turn, is connected to the inclined connector flange 36 which, in turn, is connected to the marking or support instrument 14.

As previously described, each support wheel member 68 includes the main wheel body 70 having the front wall section 74, the rear wall section 76, and the inclined support wall section 78 which is approximately at a 60 degree angle to the wheel support shaft 72 so as to place the marking or support instrument 14 inclined to the support surface 33 at an approximate 60 degree angle.

The front wall section 74 is provided with wheel rotation measurement indicia 148 thereon having a rotation counter section 150. More particularly, the rotation counter section 150 has a flat wall portion 152 and an outer support ribs 154 in order to contact the support surface 33.

The flat wall portion 152 is a starting point with the wheel rotation measurement indicia 148 thereabout indicating a complete rotation of the support wheel member 68.

The outer support ribs 154 assist in a non-slip rotational movement of the support wheel member 68 with the wheel rotation measurement indicia 148 measured in increments of from zero being $\frac{1}{4}$, $\frac{1}{2}$, and $\frac{3}{4}$ to a full revolution.

The support wheel members 68 are of a diameter equal to three tenths (3/10) of an inch and each full rotation of the support wheel member 68 as noted by an arrow 168 in FIG. 17 is equal to a length measurement of one (1) inch on the support surface 33.

The flat wall portion 152 contacts the ground support surface 156 on each full rotation of the support wheel member 68 which gives a sensation, such as a vibration, to one utilizing the adapter apparatus 12 of this invention so that the number of rotational movements and, thus, length of movement in the straight line 35 on a support surface 33, can be noted by the user thereof.

USE AND OPERATION OF THE INVENTION

In the use and operation of the first embodiment of the adapter apparatus 12 being the pen/pencil adapter assembly 26 as noted in FIGS. 1–6, inclusive, the main support member 28 is clipped on and about the pen/-pencil member 16 in a conventional manner.

The pen/pencil adapter assembly 26 is operable to slide on the pen/pencil member 16 to the position of FIG. 1 whereupon the lock protrusion element 21 adjacent the marking element 20 is engagable with the protrusion receiving hole 38 to lock in this usage condition.

Next, the alignment and ruler member 30 is pivotal as noted by an arrow 162 to the locked usage condition. This is achieved by engagement of the lock protrusion member 67 on opposite sides of the connector section 42 of the inclined connector flange 36 as noted in FIG. 5.

The user then can place the pen/pencil adapter assembly 26 and pen/pencil member 16 in the inclined position as noted in FIG. 1 on the support surface 33 such as a tablet, book, magazine, or other such item on which it is desirable to either draw a straight line or move in the straight line 35. This movement can be in either direction as noted by an arrow 160 in FIG. 1 to achieve a marking on the support surface 33 by the marking element 20.

After usage of the pen/pencil adapter assembly 26, it is obvious that the main support member 28 can be moved axially on the pen/pencil member 16 to the position as noted in FIGS. 2 and 3 with the protrusion receiving hole 60 then mounted over the lock protrusion element 21 on a portion of the pen/pencil member 16 away from the marking element 20.

Then, the alignment and ruler member 30 can be pivoted about the pivot connector member 62 as noted by the arrow 162 to the storage condition as noted in FIG. 2. This is held in this condition by the lock protrusion portion 50 being mountable within the protrusion receiving hole 60.

The outer curved clip section 54 is then in a position to cooperate with adjacent portions of the pen/pencil member 16 for clipping into a shirt pocket or the like of a person utilizing same.

In the second embodiment of the adapter apparatus 12, being the magnifying adapter assembly 80 as noted in FIGS. 7–9, inclusive, it is noted that the pen/pencil adapter assembly 26 with its main support member 28, alignment and ruler member 30, and the support wheel assembly 32 is substantially operable as previously described in the first embodiment for support on the support surface 33 which may be a newspaper, book, or magazine article and easily moved to move the marking element 20 in the straight line 35 for marking purposes.

The magnifying assembly 82 can have the magnifying member 84 moved from the storage condition shown in dotted lines in FIG. 9 to the upright usage condition as shown in solid lines for magnifying small print for ease of reading.

In the use of the third embodiment of the adapter apparatus 12 as noted in FIG. 10 this is substantially identical in use and operation to the first embodiment being the pen/pencil adapter assembly 26 except the pen/pencil adapter assembly 94 has a projection support assembly 96 instead of use of the support wheel assembly 32.

The projection support assembly 96 has the outer bearing dipple members 98 so that the lateral movement is on outer arcuate contact surfaces 102 instead of the rotatable support wheel members 68 as previously described. The pen/pencil adapter assembly 94 is able to be moved on the outer arcuate contact surface 102 along the straight line 35 as noted on the support surface 33 as similarly shown in FIG. 1.

In the use and operation of the fourth embodiment of the adapter apparatus 12, the highlighter adapter assembly 104, is as shown in a storage or non-use condition in FIG. 12. The highlighter adapter assembly 104 is mounted on the highlighter pen member 18 and the outer felt tip element 22 has been covered by the enclosure cap member 24 to prevent the the fluid therein from evaporating.

In this storage condition of FIG. 12, the highlighter adapter assembly 104 has been moved upwardly to engage the lock ring 114 with an innermost one of the lock groove 112 to hold in this storage condition. The pocket clip or flange member 116 cooperates with the main pen body 106 for clipping onto a pocket portion of a user thereof in a conventional manner.

On use of the highlighter adapter assembly 104, it is obvious that the enclosure cap member 24 is removed from the main pen body 106 and positioned on the cap storage end 108 as noted in FIG. 11.

Next, the cylindrical housing section 118 and the alignment and ruler member 30 are moved downwardly as noted by an arrow 166 to the usage position as shown in FIG. 11. With this movement, the lock ring 114 on an inner surface of the cylindrical housing housing section 118 engages the lowermost lock ring 114 to hold in this usage condition. This position has been calculated to place the felt tip element 22 at the proper relationship to a support surface 33 in order to move in the straight line 35 similar to that described on use with the pen/pencil member 16.

In the use and operation of a fifth embodiment of the adapter apparatus 12 as noted in FIGS. 13 and 14, the cutter adapter assembly 128 is mounted on the main support member 129 which can be interconnected to the marking or support instrument 14. This embodiment includes the two spaced lock grooves 112 and lock ring 114 so that the main support member 129 can be moved from the usage condition to a storage condition in a manner as previously described for the highlighter adapter assembly 104.

The cutter adapter assembly 128 is operable on movement in the straight line 35 with the alignment and ruler member 130 connected to the support wheel assembly 32 similar to the pen/pencil adapter assembly 26 as noted in FIG. 1.

For the user desiring to cut a newspaper or magazine article or portions from a book, the cutter blade assembly 132 is pivoted from the storage condition of FIG. 13 to the usage condition of FIG. 14.

On achieving this 90 degree movement, the anchor hole 144 is engagable with the lock protrusion member 136 to hold in this upright position. It is obvious that the cutter blade assembly 132 is positioned so that the inclined cutter edge 140 is extended slightly below the inclined support wall section 78 of the support wheel members 68 so as to engage a newspaper or magazine article being the support surface 33 so as to achieve a cutting action thereon.

The support wheel assembly 32 has been described in detail in FIGS. 15–17, inclusive. The diameter of the main wheel body 70 (3/10 inch) is chosen in conjunction with the wheel rotation measurement indicia 148 so that, on each rotation of the support wheel member 68, is a predetermined length distance (1 inch) as is the amount of lineal movement on the support surface 33 on the straight line 35.

The flat wall portion 152 on the rotation counter section 150 operates to give a vibration feeling to the user's hand grasping on the marking or support instrument 14 so that each vibration signal indicates a complete rotation of the support wheel members 68 and, thus, a distance of linear measurement travel (1 inch) on the support surface 33.

It is seen that the various embodiments of the adapter apparatus of this invention are mounted on a marking instrument to achieve movement in a straight line being readily movable from usage to storage conditions; easily clipped in a pocket area of a user for storage and conveyance; operable to provide means for movement in a straight line; economical to manufacture; easy to use; and substantially maintenance free.

Further embodiments of the adapter apparatus are operable to 1) utilize a magnifying member for reading of fine print; 2) utilize a highlighter pen member having means thereon for holding; in usage and non-usage conditions; and 3) provides a cutter adapter assembly for movement in a straight line in cutting out newspaper articles, grocery store coupons, and the like.

While the invention has been described in conjunction with preferred specific embodiments thereof, it will be understood this description is intended to illustrate and not to limit the scope of the invention, which is defined by the following claims:

I claim:

1. An adapter apparatus operable to be mounted on a marking instrument to achieve movement thereof in a straight line, comprising:

a) a support instrument having an elongated body member with a marking element on one end thereof;

b) an adapter assembly including a main support member mounted on said body member having an alignment and ruler member connected to said main support member and a support wheel assembly connected to said alignment and ruler member;

c) said alignment and ruler member placed in a usage position perpendicular to a longitudinal axis of said body member with said support wheel assembly and said marking element in contact with a support surface; and d) a magnifying assembly connected to said alignment and ruler member including a magnifying member movable from a storage position adjacent said alignment and ruler member to a usage position perpendicular to said alignment and ruler member operable to magnify indicia on the support surface while moving in a straight line;

whereby lateral movement of said support instrument causes said marking element and said support wheel assembly to move in parallel, straight lines.

2. An adapter apparatus operable to be mounted on a marking instrument to achieve movement thereof in a straight line, comprising:

a) a support instrument having an elongated body member with a marking element on one end thereof;

b) an adapter assembly including a main support member mounted on said body member having an alignment and ruler member connected to said main support member and a support wheel assembly connected to said alignment and ruler member;

c) said alignment and ruler member placed in a usage position perpendicular to a longitudinal axis of said body member with said support wheel assembly and said marking element in contact with a support surface; and d) a cutter blade assembly connected to said alignment and ruler member having a main blade body with an inclined cutter edge positioned in a usage condition to contact and cut the support surface;

whereby lateral movement of said support instrument causes said marking element and said support wheel assembly to move in parallel, straight lines.

3. An adapter apparatus as described in claim 2, wherein:

a) said main blade body selectively pivoted from the usage condition to a locked storage condition with said inclined cutter edge away from, and out of contact with, the support surface.

4. An adapter apparatus operable to be mounted on a marking instrument to achieve movement in a straight line, comprising:

a) a support instrument;

b) an adapter assembly including a main support member mounted on said support instrument; an alignment and ruler member connected to said main support member; and a support assembly contacted to said alignment and ruler member engagable with a support surface to cause movement of said support instrument in a straight line;

c) said support assembly having a pair of spaced support wheel members rotatable in a common plane for movement in a straight line with subsequent movement of said support instrument in a second plane parallel thereto;

d) said main support assembly having a housing section engagable with said support instrument for movement therealong from a usage condition to a storage condition and e) said housing section having a protrusion element engagable with a lock protrusion portion on an inclined connector flange of said main support member to hold in the storage condition with said housing section extended parallel to said connector flange.

5. An adapter apparatus operable to be mounted on a support member, comprising:

a) a marking instrument including a support body member with a marking element on one end thereof;

b) an instrument adapter assembly including a main support member slidably mounted on said support body member; an alignment and ruler member pivotally connected to said main support member; and a support wheel assembly mounted on said alignment and ruler member;

c) said support wheel assembly having a pair of spaced support wheel members engagable with a support surface and rotatable in a common plane;

d) said marking instrument is a highlighter pen member having said marking element with a felt tip element selectively enclosed with an enclosure cap member; and e) said highlighter pin member having a lock section adjacent said marking element engagable with a lock element on said main support member to hold in a first non-usage condition with said enclosure cap member enclosing said felt tip element to prevent fluid evaporation and to hold in a second usage condition to position said support wheel assembly and said felt tip element conjointly against the support surface for a highlighting function.

6. An adapter apparatus as described in claim 5, wherein:

a) said support member having a pocket clip member engagable with an outer surface of said highlighter pen member and operable to be releasably connected to a user's shirt pocket or the like.

7. An adapter apparatus as described in claim 5, including:

a) a cutter blade assembly connected to said alignment and ruler member having an inclined cutter edge positioned in a usage condition to contact and cut the support surface in a straight line on lateral movement of said marking instrument and said support wheel members in contact with the support surface.

8. An adapter apparatus as described in claim 7, wherein:

a) said cutter edge pivoted from the usage condition to a locked storage condition out of contact and away from the support surface.

* * * * *